US007819487B2

(12) United States Patent
Weaver

(10) Patent No.: US 7,819,487 B2
(45) **Date of Patent: *Oct. 26, 2010**

(54) METHOD OF MOLDING A CLEANING DEVICE WITH A SQUEEGEE

(75) Inventor: Jace A. Weaver, Gilbertsville, PA (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/703,393

(22) Filed: Feb. 10, 2010

(65) Prior Publication Data

US 2010/0140836 A1 Jun. 10, 2010

Related U.S. Application Data

(63) Continuation of application No. 11/438,048, filed on May 19, 2006, now Pat. No. 7,717,524.

(51) Int. Cl.
*A47L 13/11* (2006.01)
*A47L 13/12* (2006.01)

(52) U.S. Cl. ..... 300/21; 15/117; 15/245; 264/243; 264/250; 264/255; 264/259; 264/271.1; 264/275

(58) Field of Classification Search ..... 15/117, 15/121, 245; 264/243, 250, 255, 259, 271.1, 264/275, 328.8; 300/21
See application file for complete search history.

(56) References Cited

U.S. PATENT DOCUMENTS

| | | | |
|---|---|---|---|
| 66,611 | A | 7/1867 | Morahan |
| 94,728 | A | 9/1869 | Brown |
| 106,644 | A | 8/1870 | Wood |
| 206,212 | A | 7/1878 | Balch |
| 307,517 | A | 5/1890 | Mallory et al. |
| 490,472 | A | 1/1893 | Clements |
| 729,338 | A | 5/1903 | Hawkins |

(Continued)

FOREIGN PATENT DOCUMENTS

| | | |
|---|---|---|
| EP | 1344480 | 9/2003 |

(Continued)

OTHER PUBLICATIONS

Non-Final Office Action dated Aug. 14, 2009 for corresponding U.S. Appl. No. 11/438,048 , 8 pgs.

*Primary Examiner*—Mark Spisich
(74) *Attorney, Agent, or Firm*—John F. Letchford; Archer & Greiner, P.C.

(57) ABSTRACT

A cleaning device and a method of manufacturing a cleaning device are provided. The method may include molding a squeegee blade out of a first material, providing a mold insert including a slot, providing a mold including a mold cavity, placing a first portion of the molded squeegee blade into the slot of the mold insert with a second portion of the molded squeegee blade exposed externally of the mold insert, placing the mold insert with the molded squeegee blade therein into the mold cavity, and subsequently molding a head member of the cleaning device, out of a second material of greater hardness than said first material, to the second portion of said previously molded squeegee blade by adding the second material to the mold cavity.

11 Claims, 6 Drawing Sheets

U.S. PATENT DOCUMENTS

| | | | |
|---|---|---|---|
| 865,351 | A | 9/1907 | Bierley |
| 1,759,091 | A | 5/1930 | Brooks et al. |
| 1,818,917 | A | 8/1931 | Wolf |
| 2,243,607 | A | 5/1941 | Rosen et al. |
| 2,741,788 | A | 4/1956 | Shey |
| 3,619,845 | A | 11/1971 | Partridge et al. |
| 3,995,345 | A | 12/1976 | Larsson |
| 4,607,411 | A | 8/1986 | Lewis, Jr. |
| 5,966,771 | A | 10/1999 | Stroud |
| 2003/0131431 | A1 | 7/2003 | Hay |
| 2004/0211020 | A1 | 10/2004 | Varner |

FOREIGN PATENT DOCUMENTS

| | | |
|---|---|---|
| WO | 9633649 | 10/1996 |
| WO | 0010446 | 3/2000 |

METHOD OF MOLDING A CLEANING DEVICE WITH A SQUEEGEE

CROSS-REFERENCE TO RELATED APPLICATIONS

The present application is a continuation of U.S. patent application Ser. No. 11/438,048, filed May 19, 2006 now U.S. Pat. No. 7,717,524, the entire contents of which are incorporated herein by reference.

BACKGROUND

There are existing cleaning devices, such as brooms, which are adapted to sweep floors and which also have attached squeegees allowing the user to squeegee a surface. Some of these existing cleaning devices are manufactured utilizing costly, timely, and/or difficult manufacturing processes. Moreover, some of the cleaning devices manufactured using the above referenced processes may have an excessive number of parts, may have durability issues, may utilize parts made of the same material when varying materials would be preferred, and/or may experience a variety of other problems.

There is a need for cleaning devices which are adapted to sweep floors and which also have attached squeegees, and for methods of their manufacture, which will reduce one or more of the problems encountered with one or more of the existing cleaning devices and/or methods of their manufacture.

SUMMARY

In one example, a method of manufacturing a cleaning device adapted to sweep floors is disclosed. A squeegee blade is molded out of a first material. Subsequently, a head member is molded, out of a second material of greater hardness than the first material, to a first portion of the previously molded squeegee blade. Bristles and a handle are attached to the head member.

In another example, a method of manufacturing a broom for sweeping floors is disclosed. A squeegee blade is molded out of a first material. Subsequently, a head member is molded around a first portion of the previously molded squeegee blade with a second portion of the squeegee blade protruding from a side surface of the head member. The head member is molded to have a socket at a top surface of the head member, and is molded out of a second material of greater hardness than the first material. Bristles are attached to a bottom surface of the head member. A handle is inserted into the socket of the top surface of the head member.

In a further example, a sweeping apparatus adapted to sweep floors is disclosed. The sweeping apparatus comprises a head member molded of a first material, a squeegee blade molded of a second material which is softer than the first material, bristles attached to a bottom surface of the head member, and a handle attached to a socket in the head member. A top surface of the head member is defined by the socket and a side surface of the head member is defined by a slot. A first portion of the squeegee blade is disposed within the slot and a second portion of the squeegee blade protrudes out of the slot. During manufacturing of the sweeping apparatus, the squeegee blade was initially molded by itself and the head member was later molded to the squeegee blade.

In yet another example, a method of manufacturing a cleaning device is provided and includes molding a squeegee blade out of a first material, providing a mold insert including a slot, providing a mold including a mold cavity, placing a first portion of the molded squeegee blade into the slot of the mold insert with a second portion of the molded squeegee blade exposed externally of the mold insert, placing the mold insert with the molded squeegee blade therein into the mold cavity, and subsequently molding a head member of the cleaning device, out of a second material of greater hardness than said first material, to the second portion of said previously molded squeegee blade by adding the second material to the mold cavity.

These and other features, aspects and advantages will become better understood with reference to the following drawings, description and claims.

DETAILED DESCRIPTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Generally, the instant invention discloses varying methods of manufacturing cleaning devices which are adapted to clean floors, and are also adapted to squeegee surfaces. The disclosed methods of manufacture produce the referenced cleaning devices having differing material parts molded together. Also disclosed are differing embodiments of cleaning devices adapted to clean floors manufactured under the disclosed methods.

Figure 1:
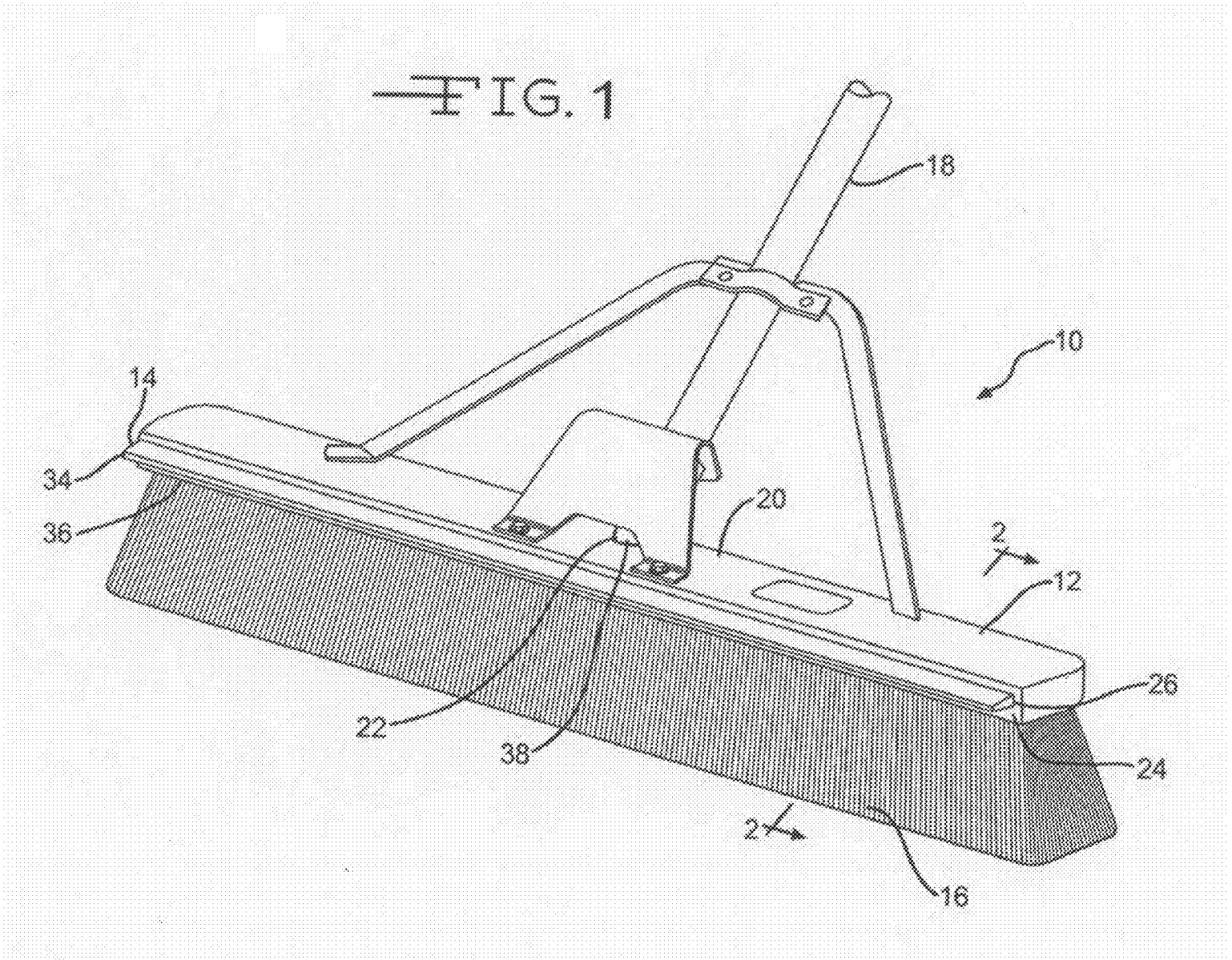
FIG. 1 depicts a perspective view of one example of a sweeping apparatus.
Figure 2:
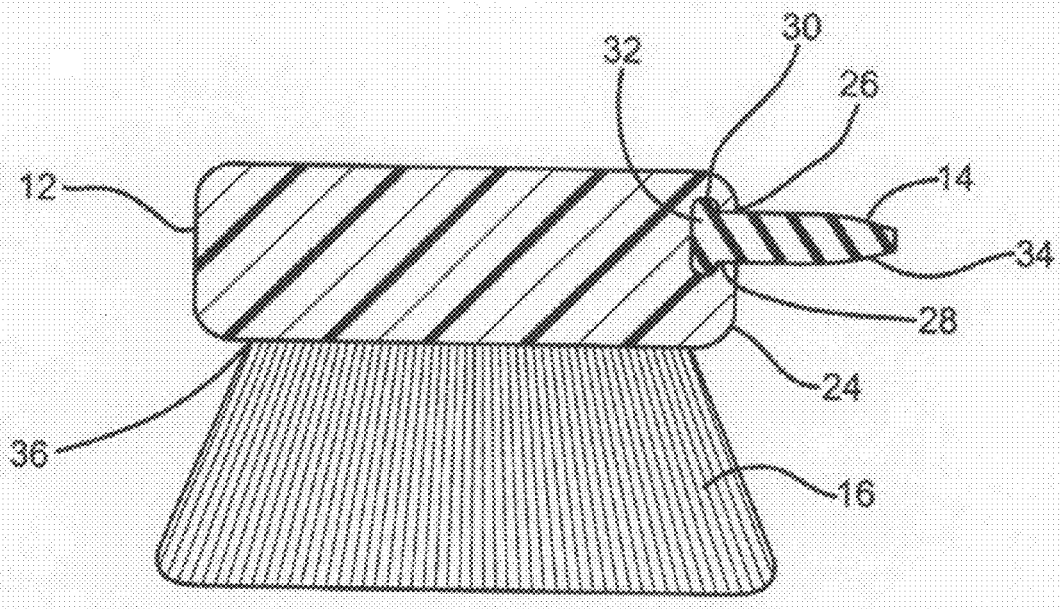
FIG. 2 depicts a partial cross-sectional view along line 2-2 of the sweeping apparatus shown in the example of FIG. 1.

FIG. 1 depicts a perspective view of one embodiment of a sweeping apparatus 10 under the invention. FIG. 2 depicts a partial cross-sectional view along line 2-2 of the sweeping apparatus shown in the embodiment of FIG. 1. The sweeping apparatus 10 may comprise a broom adapted to sweep floors, or other sweeping device known in the art. As shown in FIGS. 1 and 2, the sweeping apparatus 10 may comprise a head member 12, a squeegee blade 14, a plurality of bristles 16, and a handle 18. During manufacturing of the sweeping apparatus 10, the squeegee blade 14 may have been initially molded by itself out of one material, and subsequently the head member 12 may have been molded out of another material to the squeegee blade 14. The head member 12 may be molded of a material, such as plastic, which is harder than the material, such as rubber, from which the squeegee blade 14 was molded. In other embodiments, the head member 12 and squeegee blade 14 may be molded from varying materials of differing hardness.

The head member 12 may comprise a generally rectangular shape. In other embodiments, the head member 12 may comprise varying shapes, sizes, configurations, and orientations.

A top surface 20 of the head member 12 may be defined by a socket 22. The socket 22 may comprise a threaded generally cylindrical shape. In other embodiments, the socket 22 may not be threaded and may comprise varying shapes, sizes, configurations, and orientations. A side surface 24 of the head member 12 may be defined by a slot 26. The slot 26 may comprise a generally rectangular portion 28 and another curved portion 30 which may be wider than the width of the rectangular portion 28. In other embodiments, the slot 26 may comprise varying shapes, sizes, configurations, and orientations.

The squeegee blade 14 may comprise two portions, 32 and 34, which are generally perpendicular to one another. In other embodiments, the squeegee blade 14 may comprise varying shapes, sizes, configurations, and orientations. The first portion 32 of the squeegee blade 14 may be completely disposed within the slot 26 while the other portion 34 of the squeegee blade 14 may protrude out of the slot 26. As shown in FIG. 2, the curved portion 30 of the slot 26 may hold in the first portion 32 of the squeegee blade 14 thereby preventing the squeegee blade 14 from slipping out of the slot 26. In such manner, the squeegee blade 14 may be attached to the head member 12.

The bristles 16 may comprise a plurality of generally cylindrical members which are staple-set to a bottom surface 36 of the head member 12. The bristles 16 may be made of plastic fibers. In other embodiments, the bristles 16 may be made of varying materials, may comprise varying shapes, sizes, configurations, and orientations, and may be attached to any portion of the head member 12 utilizing varying attachment mechanisms known in the art.

The handle 18 may be in a generally cylindrical shape and may be made of steel or wood. In other embodiments, the handle 18 may be in varying shapes, sizes, configurations, and orientations, and may be made of differing materials. An end 38 of the handle 18 may be threaded and may be screwed into the threaded socket 22. In such manner, the handle 18 may be attached to the socket 22 of the head member 12.

Figure 3:
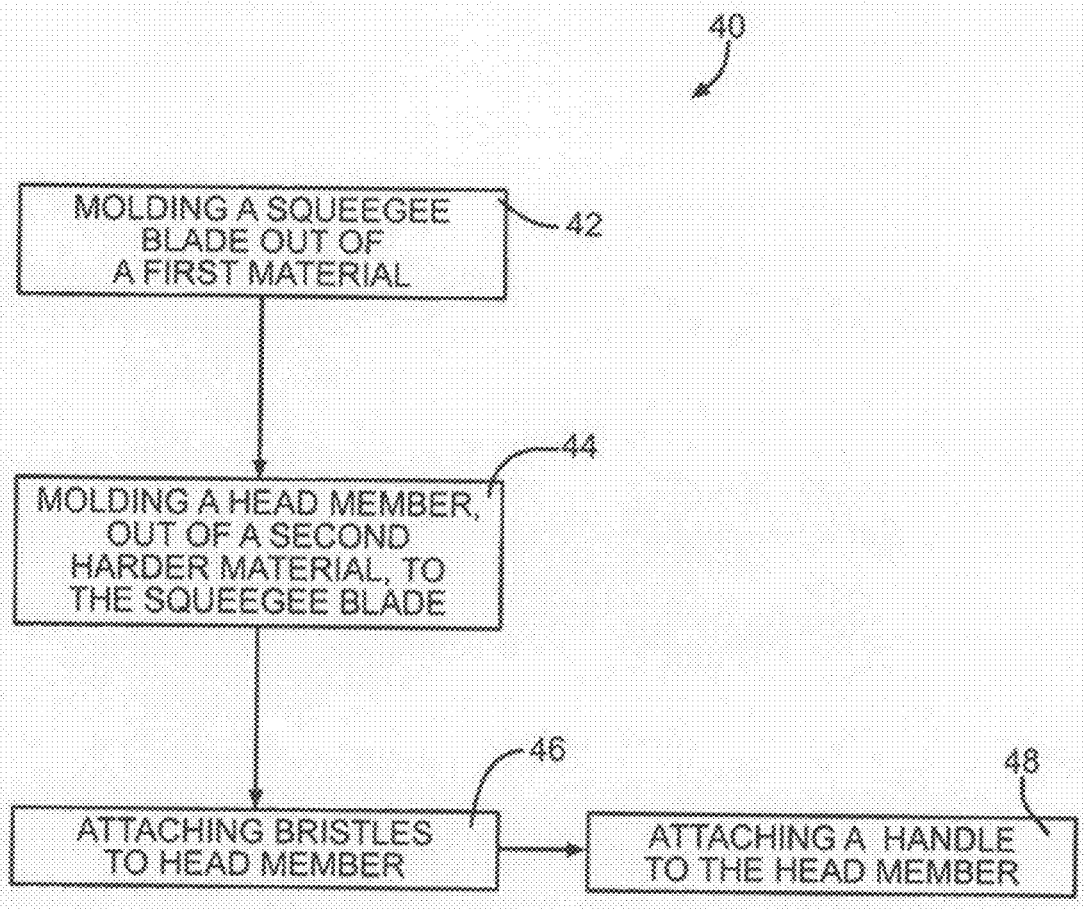
FIG. 3 depicts one example of a method under the invention of manufacturing a cleaning device adapted to sweep floors.

FIG. 3 depicts one embodiment of a method 40 under the invention of manufacturing a cleaning device adapted to sweep floors. The manufactured cleaning device may comprise a broom, or other sweeping device known in the art. In step 42, a squeegee blade may be molded out of a first material. The first material may comprise rubber, or other materials known in the art.

Subsequently, in step 44, a head member may be molded, out of a second material of greater hardness than the first material, to a portion of the previously molded squeegee blade. The second material may comprise plastic, or other materials known in the art. During molding of the head member, the head member may be molded around a first portion of the previously molded squeegee blade with a second portion of the squeegee blade protruding from a side surface of the head member. The head member may be molded so that a side surface of the head member is defined by a slot. The head member may also be molded so that a top surface of the head member is defined by a socket. During molding of the head member, the head member may be molded so that a first portion of the squeegee blade is disposed within the slot of the head member while a second portion of the squeegee blade protrudes out of the slot.

In step 46, bristles may be attached to the head member. During attachment of the bristles, the bristles may be attached to a bottom surface of the head member. In step 48, a handle may be attached to the head member. The handle may be attached to the head member by inserting an end of the handle into a socket in the head member.

Figure 4:
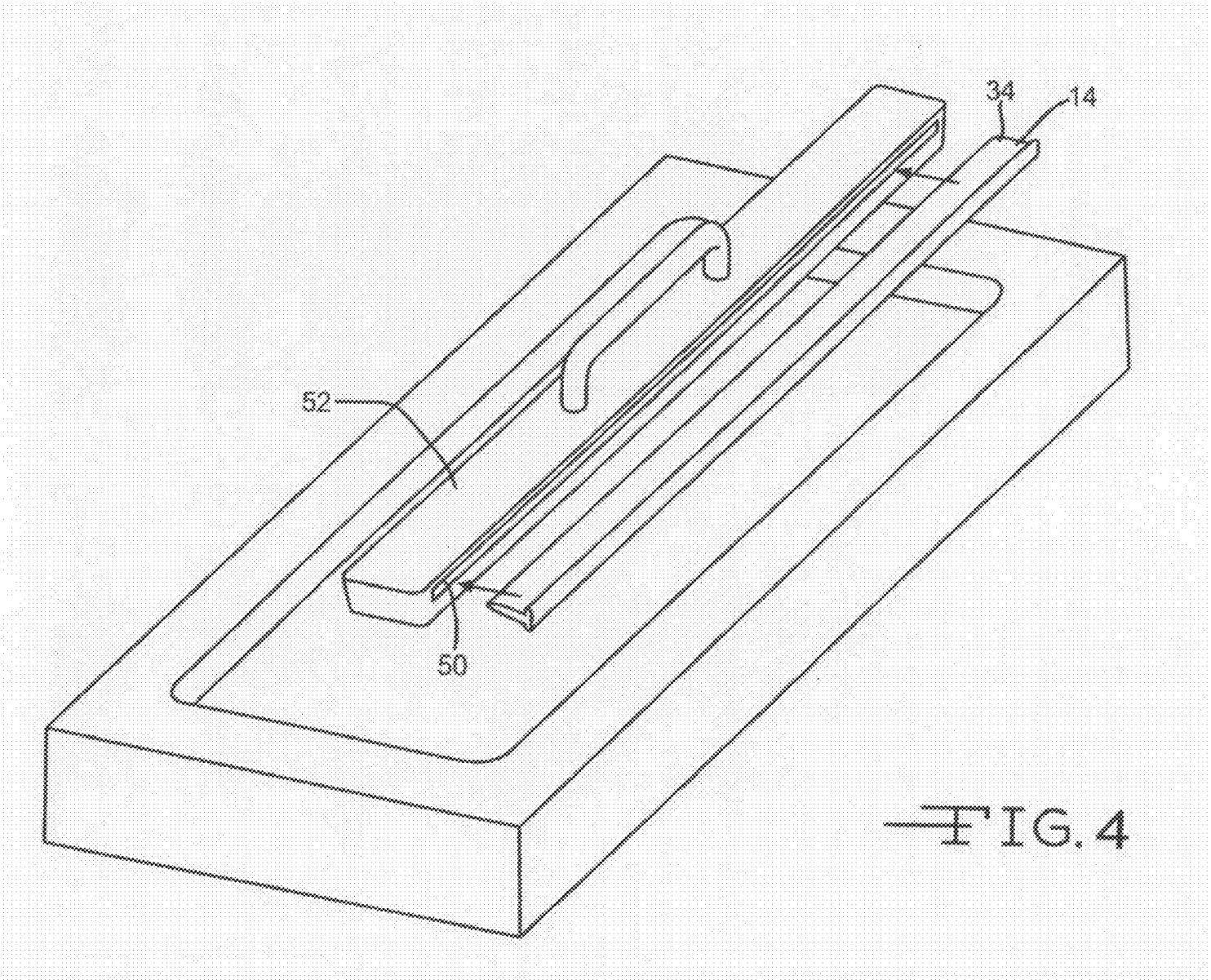
FIG. 4 depicts the step of placing a portion of a pre-molded, rubber, squeegee blade into a slot of a mold-insert under one example of a method of manufacturing a cleaning device under the invention.
Figure 5:
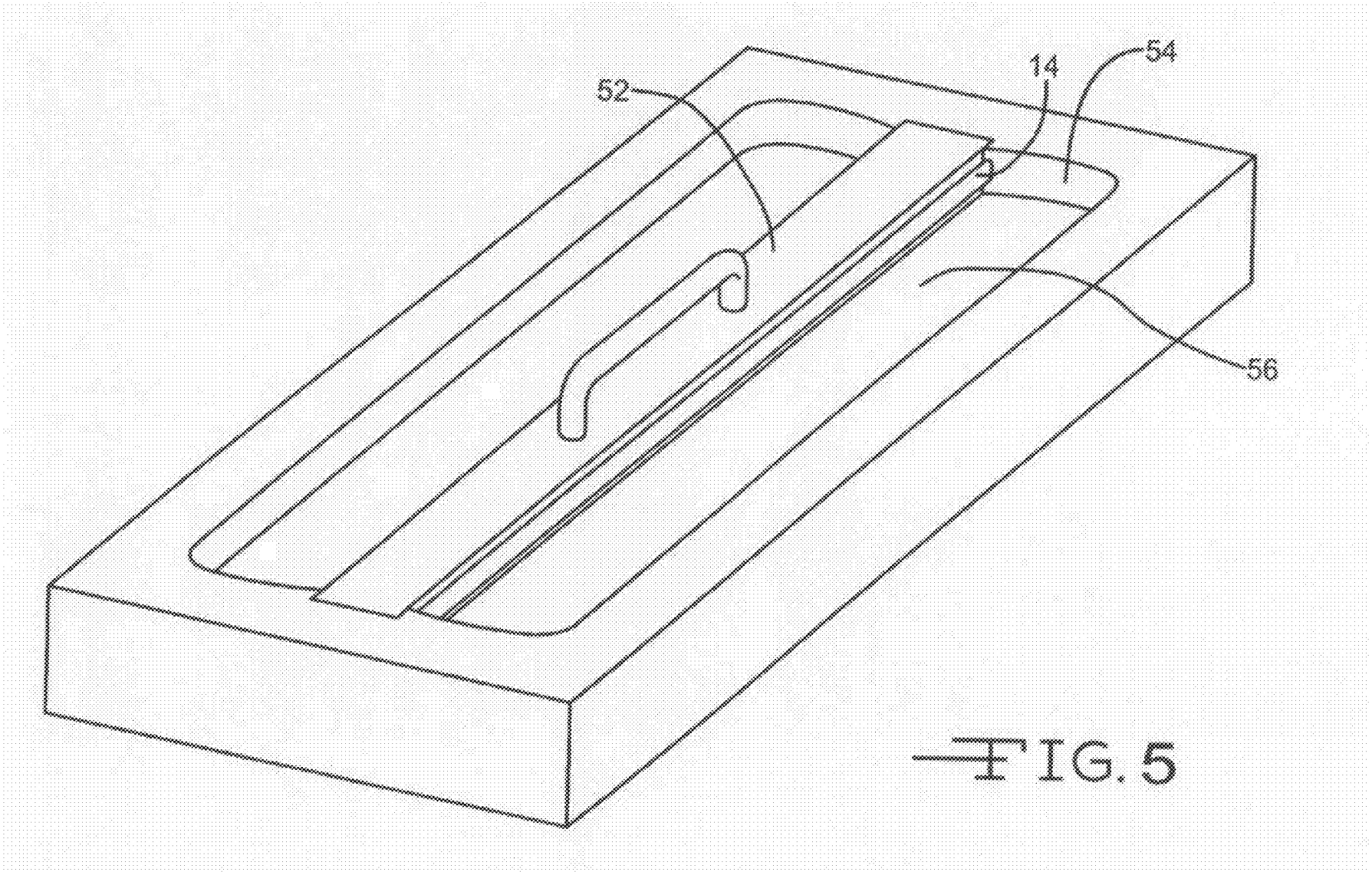
FIG. 5 depicts the step of placing the mold-insert into the mold in the embodiment of FIG. 4.
Figure 6:
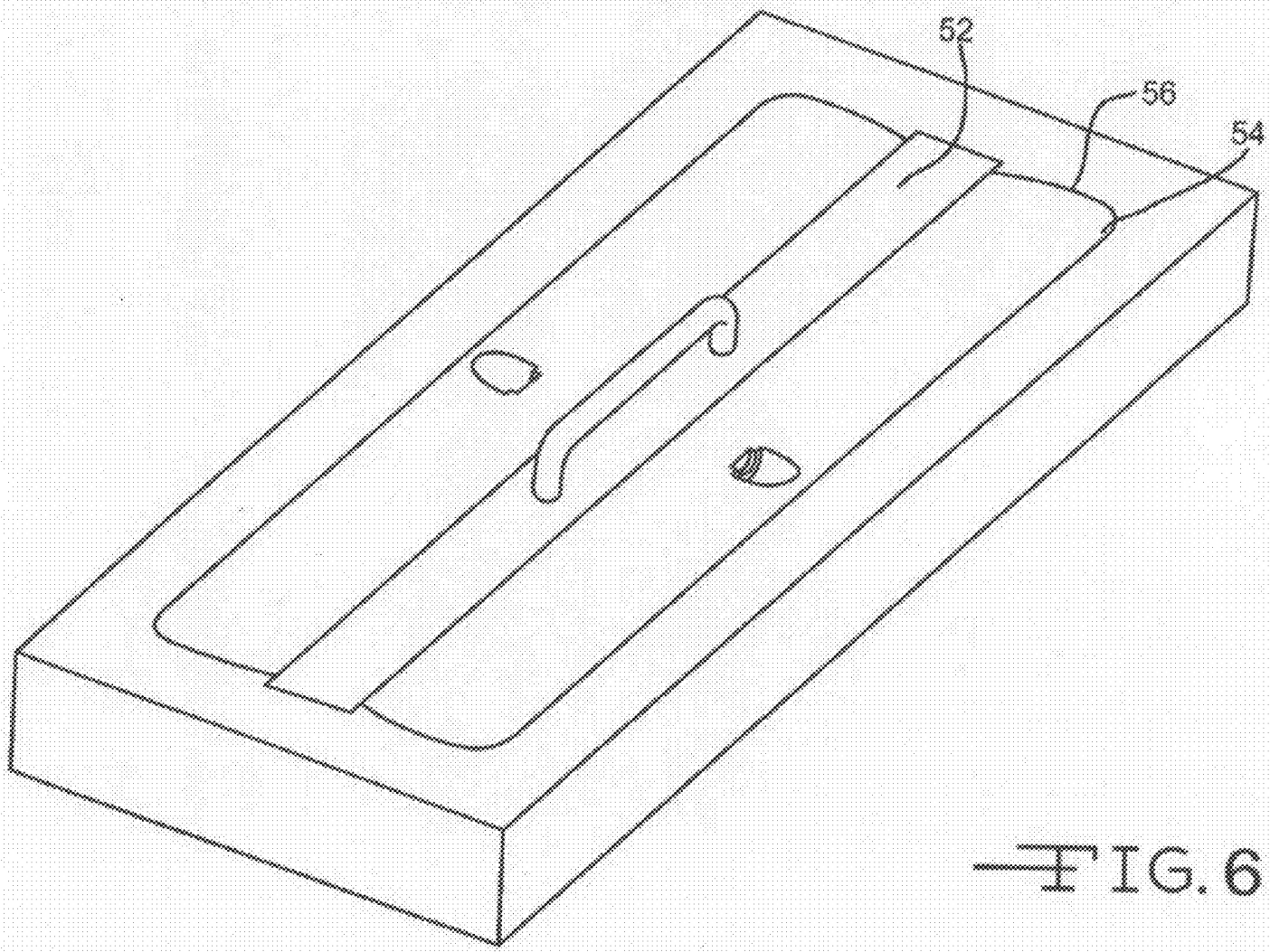
FIG. 6 depicts the step of injecting plastic to fill the cavity of the mold in the embodiment of FIG. 5.

FIGS. 4, 5, and 6 show one embodiment of multiple steps which may be followed to mold head-member 12 to squeegee blade 14. As shown in FIG. 4, a portion 34 of a pre-molded, rubber, squeegee blade 14 may be placed into a slot 50 of a mold-insert 52. Subsequently, as shown in FIG. 5, the mold-insert 52 may be placed into a mold 54. The mold 54 may be defined by a cavity 56 which is shaped in the configuration of the head-member 12. As shown in FIG. 6, plastic may then be injected to fill the cavity 56 of the mold 54. After the plastic has fully molded in the cavity 56, the mold-insert 52 may be removed from the cavity 56 and the molded together head-member 12 and squeegee blade 14 may be removed from the mold-insert 52. In such manner, the head-member 12 may be molded to the pre-molded squeegee blade 14 to form an integral part.

It should be understood, of course, that the foregoing relates to exemplary embodiments of the invention and that modifications may be made without departing from the spirit and scope of the invention as set forth in the following claims.

We claim:

1. A method of manufacturing a cleaning device, the method comprising:

molding a squeegee blade out of a first material;

providing a mold insert including a slot;

providing a mold including a mold cavity;

placing a first portion of the molded squeegee blade into the slot of the mold insert with a second portion of the molded squeegee blade exposed externally of the mold insert;

placing the mold insert with the molded squeegee blade therein into the mold cavity; and subsequently molding a head member of the cleaning device, out of a second material of greater hardness than said first material, to the second portion of said previously molded squeegee blade by adding the second material to the mold cavity.

2. The method of claim 1, wherein the method is for manufacturing a broom.

3. The method of claim 1, wherein during the step of molding said squeegee blade, said squeegee blade is molded using rubber.

4. The method of claim 1, wherein during the step of molding said head member, said head member is molded using plastic.

5. The method of claim 1, wherein during the step of molding said head member, the first portion of said squeegee blade protrudes from a side surface of said head member.

6. The method of claim 1, wherein during the step of molding said head member, said head member is molded so that a side surface of said head member defines a slot.

7. The method of claim 6, wherein during the step of molding said head member, the second portion of the squeegee blade is disposed within said slot of said head member and the first portion of said squeegee blade protrudes out of said slot of said head member.

8. The method of claim 1, further comprising the step of attaching bristles to a bottom surface of the head member.

9. The method of claim 1, wherein during the step of molding said head member, said head member is molded so that a top surface of said head member defines a socket.

10. The method of claim 9, further comprising attaching a handle to said head member.

11. The method of claim 10, wherein the step of attaching a handle to said head member further comprises inserting the handle into the socket.

* * * * *